US006669045B2

(12) United States Patent
Wang

(10) Patent No.: US 6,669,045 B2
(45) Date of Patent: Dec. 30, 2003

(54) FOLDING COLLAPSIBLE COMBINATION STORAGE BOX ASSEMBLY

(76) Inventor: Wen Tsan Wang, PO Box 82-144, Taipei (TW)

( * ) Notice: Subject to any disclaimer, the term of this patent is extended or adjusted under 35 U.S.C. 154(b) by 42 days.

(21) Appl. No.: 09/995,873

(22) Filed: Nov. 29, 2001

(65) Prior Publication Data

US 2003/0098303 A1 May 29, 2003

(51) Int. Cl.[7] ..... B65D 30/06

(52) U.S. Cl. ..... 220/9.2; 220/9.2; 190/126; 190/127

(58) Field of Search ..... 220/9.3, 9.2; 190/126, 190/127

(56) References Cited

U.S. PATENT DOCUMENTS

| | | | | | |
|---|---|---|---|---|---|
| 2,030,204 | A | * | 2/1936 | Gray | 220/9.2 |
| 2,458,797 | A | * | 1/1949 | Prag | 248/97 |
| 5,560,385 | A | * | 10/1996 | Zheng | 135/125 |
| 5,964,533 | A | * | 10/1999 | Ziglar | 383/36 |
| 6,102,569 | A | * | 8/2000 | Wang | 383/104 |
| 6,149,025 | A | * | 11/2000 | Wang | 220/6 |

* cited by examiner

*Primary Examiner*—Joseph Man-Fu Moy
(74) *Attorney, Agent, or Firm*—Leong C. Lei

(57) ABSTRACT

A folding collapsible combination storage box assembly is constructed to include at least one collapsible fabric box body of rectangular shape each having a horizontal top open side, a plurality of upright support rods respectively embedded in four corners of each collapsible box body, and a hard base plate respectively fitted into each collapsible box body and supported on the horizontal bottom panel of each collapsible box body for supporting storage items.

2 Claims, 8 Drawing Sheets

FOLDING COLLAPSIBLE COMBINATION STORAGE BOX ASSEMBLY

BACKGROUND OF THE INVENTION

1. Field of the Invention

The present invention relates to storage boxes and, more particularly, to a folding collapsible combination storage box assembly.

2. Description of the Related Art

Conventional storage boxes, cabinets, and racks occupy much storage space during delivery because they are not folding collapsible. In order to eliminate this problem, folding collapsible storage devices are developed. There is known a folding collapsible storage box, which comprises a collapsible fabric box body, four horizontal rod members respectively embedded in the top sides of the four vertical side panels of the box body, two horizontal rod member respectively embedded in the bottom sides of two opposite vertical side panels of the box body, four vertical rod members respectively embedded into the box body in four corners between each two adjacent vertical side panels, and four sets of triangle plates respectively fixedly fastened to the vertical side panels of the box body. When not in use, the box body is twisted into a collapsed condition. The triangle plates guide the twisting action, enabling the box body to be easily twisted into the collapsed condition. This structure of folding collapsible storage box is functional, however it is complicated and expensive to manufacture.

SUMMARY OF THE INVENTION

The present invention has been accomplished under the circumstances in view. It is one object of the present invention to provide a folding collapsible combination storage box, which can easily be twisted into a collapsed flat manner to minimize storage occupation. It is another object of the present invention to provide a folding collapsible combination storage box, which is easy and inexpensive to manufacture. According to one aspect of the present invention, the folding collapsible combination storage box assembly comprises at least one collapsible fabric box body of rectangular shape each having a horizontal top open side, a plurality of upright support rods respectively embedded in four corners of each collapsible box body, and a hard base plate respectively fitted into each collapsible box body and supported on the horizontal bottom panel of each collapsible box body for supporting storage items. According to another aspect of the present invention, each box body has a cover flap mounted with a zip fastener for closing the top open side of the respective box body. According to still another aspect of the present invention, each box body has a side pocket for keeping small items.

DETAILED DESCRIPTION OF THE PREFERRED EMBODIMENT

Figure 1:
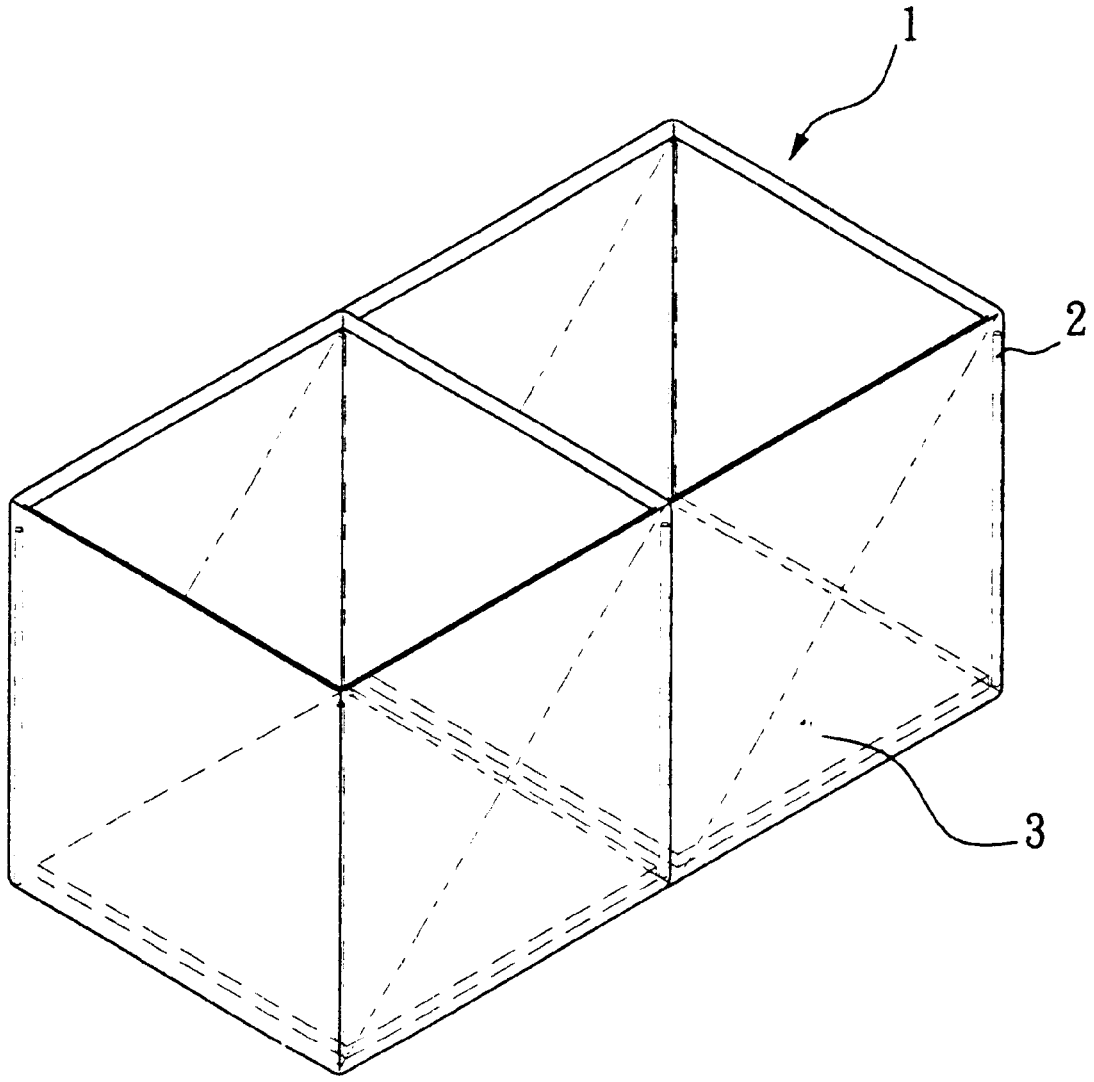
FIG. 1 is a perspective view of a folding collapsible combination storage box assembly constructed according to a first embodiment of the present invention.
Figure 2:
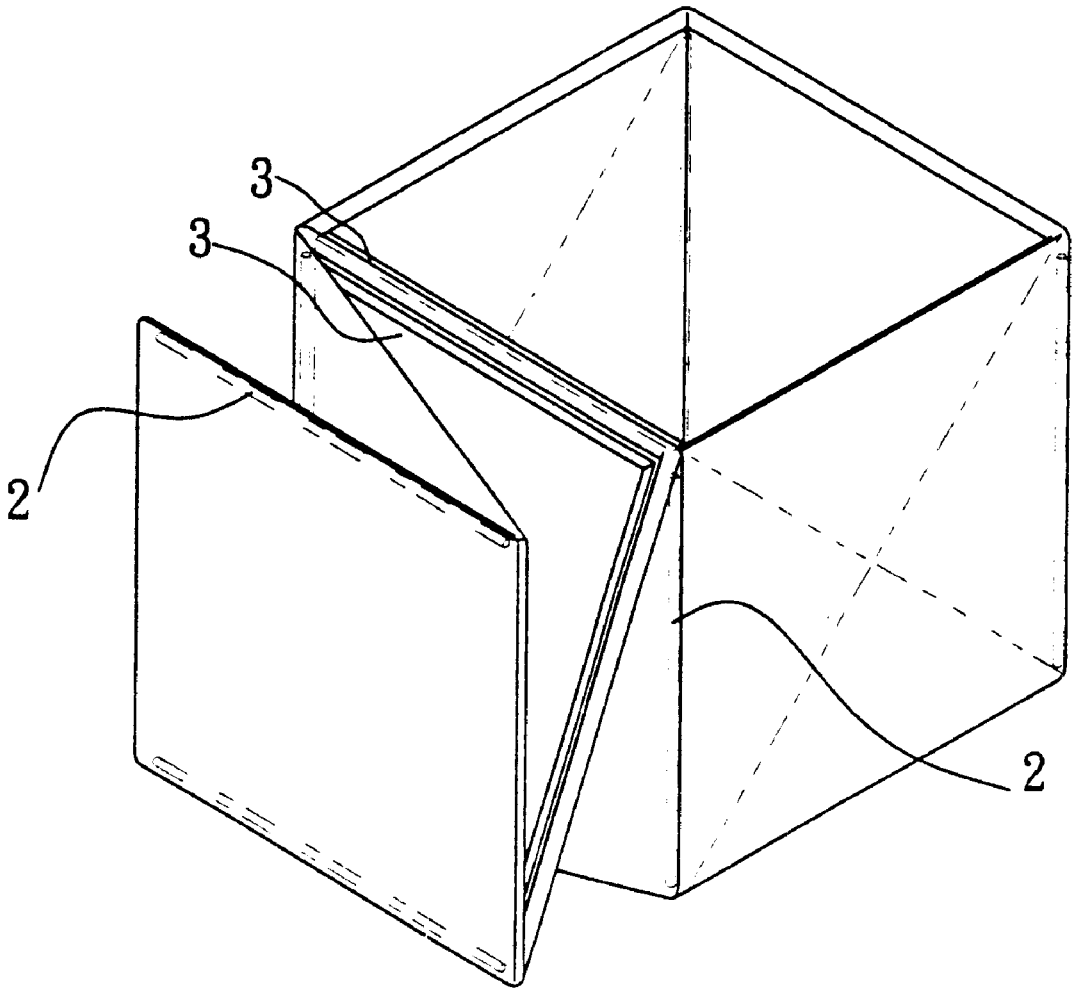
FIG. 2 shows the collapsing action of the first embodiment of the present invention where the base plate is lifted, and one box unit is twisted.

Referring to FIGS. 1 and 2, a folding collapsible combination storage box assembly in accordance with a first embodiment of the present invention is comprised of a plurality of rectangular box units fastened to one another side by side by stitches. According to this embodiment, the folding collapsible combination storage box assembly is comprised of two box units. Each unit comprises a collapsible box body 1, four upright support rods 2, and a hard base plate 3. The collapsible box body 1 is formed of strong and resilient fabric (for example, canvas), having four vertical peripheral side panels and a horizontal bottom side and defining a top opening. The four upright support rods 2 are embedded in the four corners of the collapsible box body 1. The two box units have a common vertical side panel, i.e., the two box units commonly use two upright support rods 2 in the bottom vertical peripheral side panel.

Referring to FIG. 1 again, when in use, the collapsible box bodies 1 of the two box units are extended out, and supported in the rectangular shape by the upright support rods 2, and the two hard base plates 3 are respectively fitted into the collapsible box bodies 1 for supporting storage items in the collapsible box bodies 1.

Figure 3:
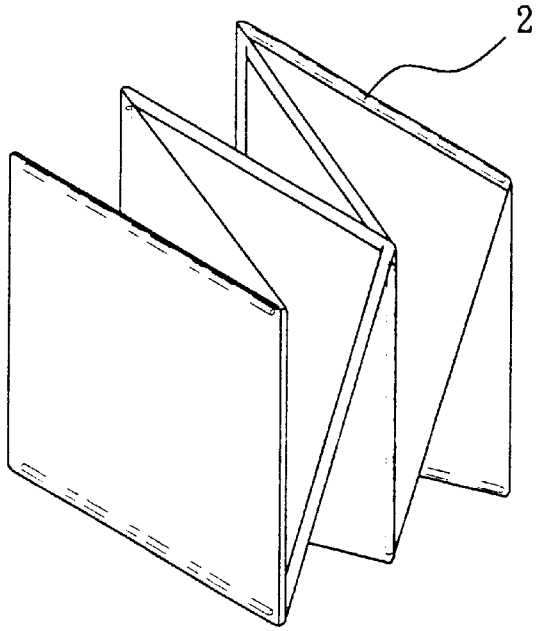
FIG. 3 shows the collapsing action of the first embodiment of the present invention where the second box unit is twisted to the collapsed manner after collapsing of the first box unit.
Figure 4:
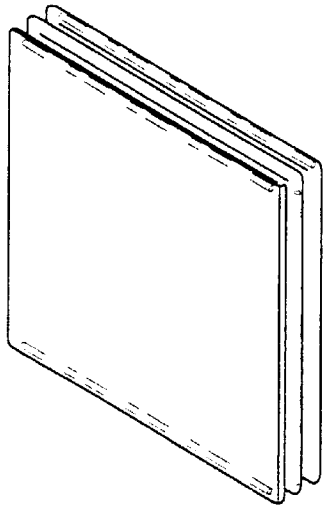
FIG. 4 shows the folding collapsible combination storage box assembly of the first embodiment of the present invention set in the collapsed condition.

Referring to FIGS. 3 and 4 and FIGS. 1 and 2 again, when not in use the hard base plate 3 of each box unit is respectively lifted from horizontal to vertical and closely attached to one vertical peripheral side panel of the respective collapsible box body 1, and then one box unit is twisted through 90° and arranged into a collapsed flat manner closely attached to the other box unit (see FIG. 2), and then the collapsed box unit is twisted with the other box unit into a collapsed flat manner (see FIGS. 3 and 4). When folded up, the collapsed combination storage box assembly occupies little storage space, and is convenient for carrying with the hand.

Figure 5:
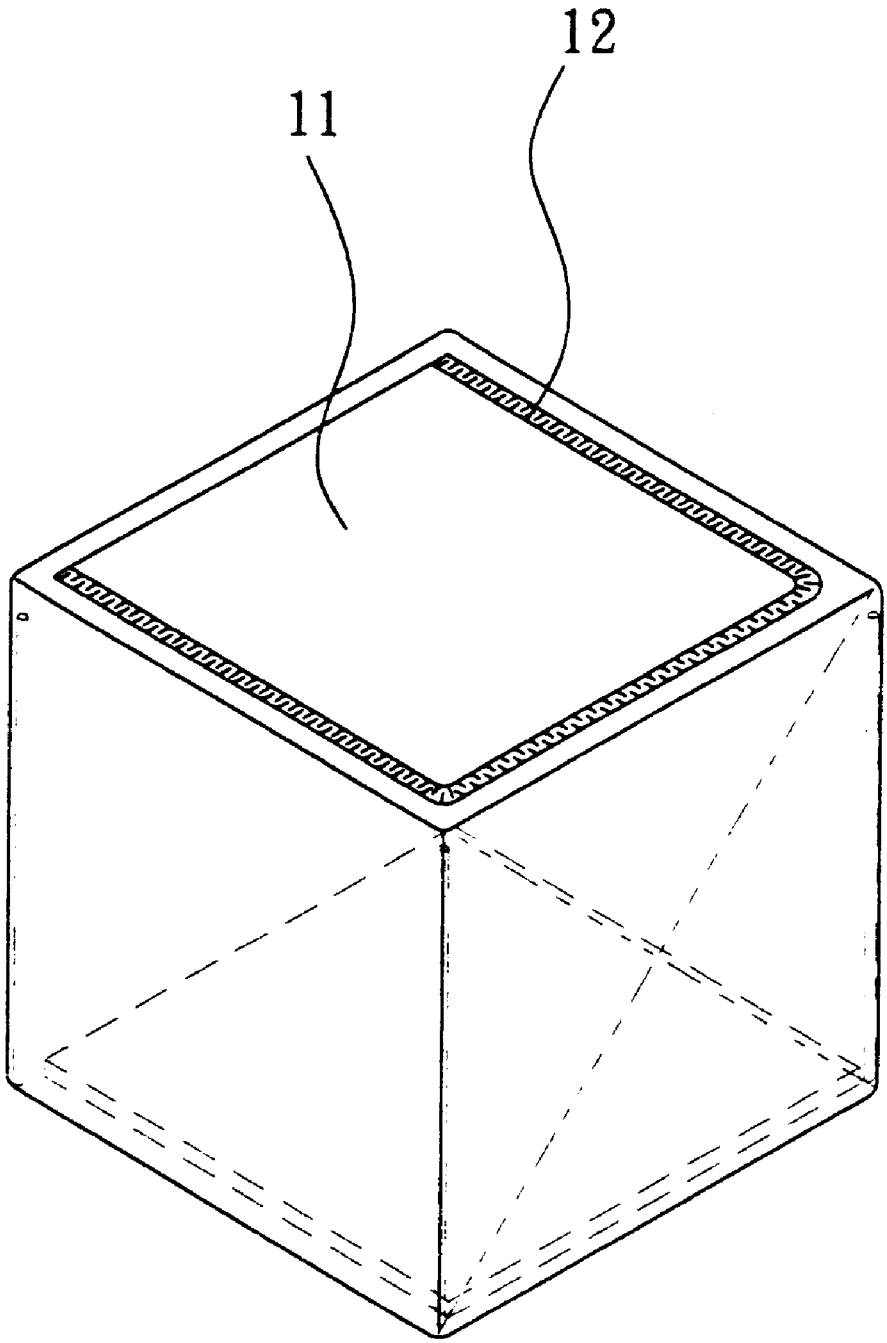
FIG. 5 is a perspective view of the folding collapsible combination storage box assembly constructed according to a second embodiment of the present invention.

FIG. 5 shows a folding collapsible combination storage box assembly constructed according to a second embodiment of the present invention. According to this embodiment, the box body 1 of the folding collapsible combination storage box assembly has a rectangular fabric cover panel 11 adapted for closing the top open side of the box body 1. The rectangular fabric cover panel 11 has one peripheral side fixedly fastened to the topmost edge of one vertical peripheral side panel of the box body 1 by stitches, and the other three sides detachably fastened to the topmost edges of the other three vertical peripheral side panels of the box body 1 by a zip fastener 12.

Figure 6:
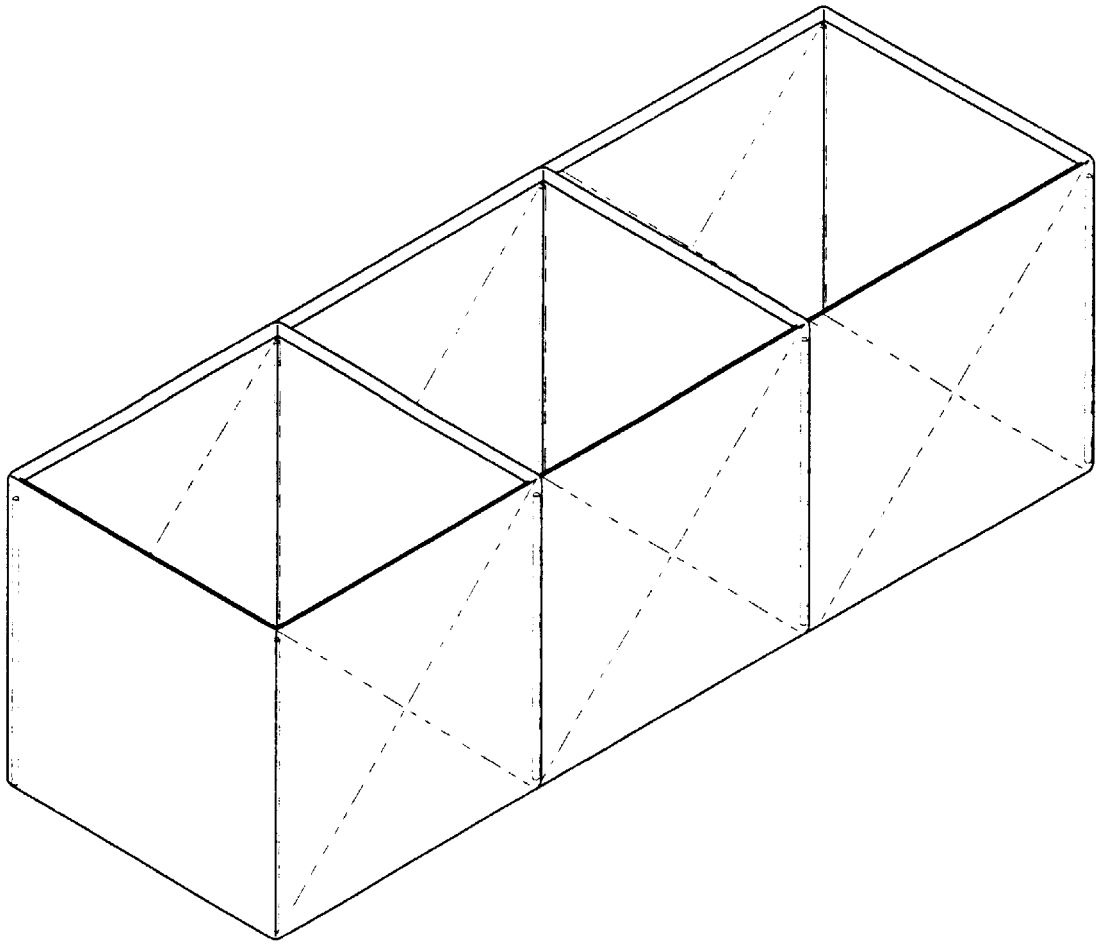
FIG. 6 is a perspective view of the folding collapsible combination storage box assembly constructed according to a third embodiment of the present invention.

FIG. 6 shows a folding collapsible combination storage box assembly constructed according to a third embodiment of the present invention. According to this embodiment, the folding collapsible combination storage box assembly comprises three box units horizontally connected in a line, each two adjacent box unit having a common vertical peripheral side panel. The box units are constructed in the same manner as that shown in FIG. 1.

Figure 7:
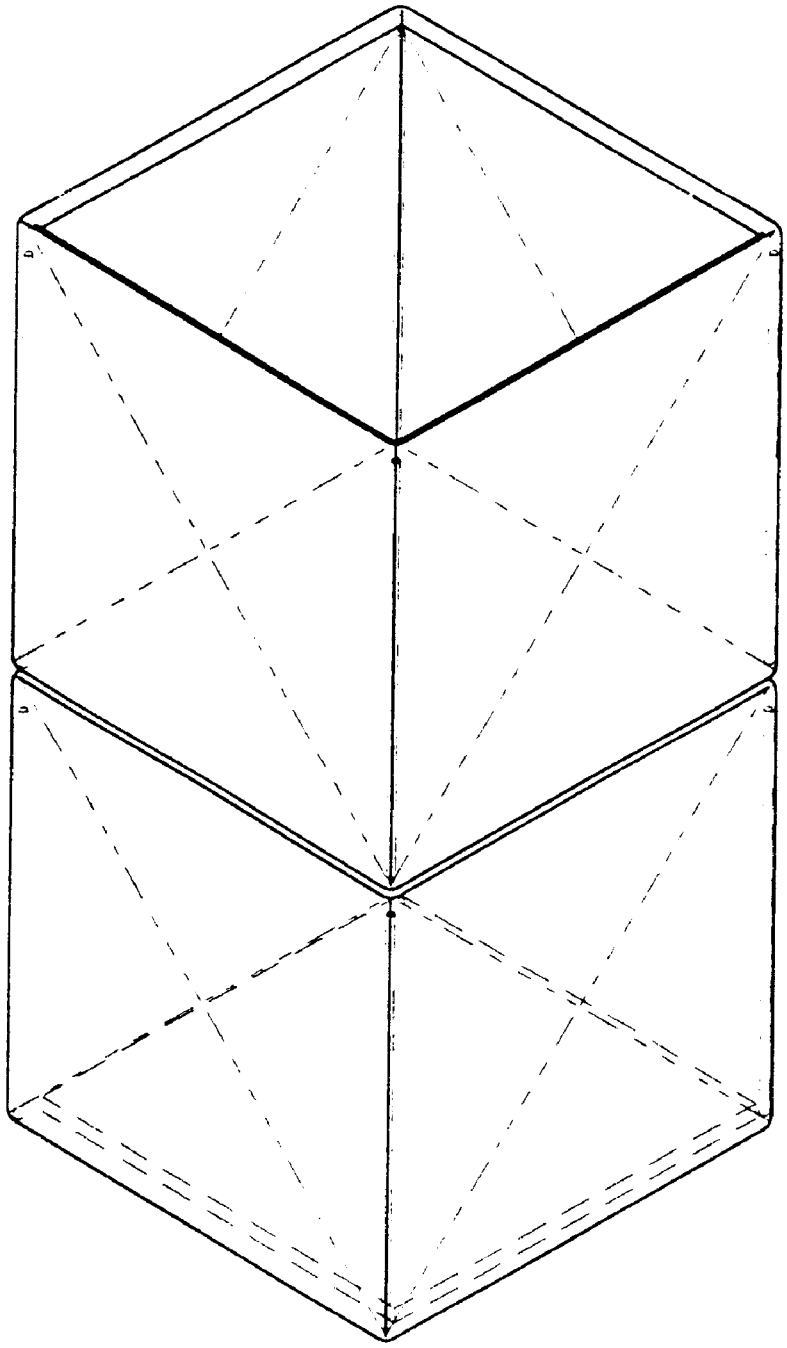
FIG. 7 is a perspective view of the folding collapsible combination storage box assembly constructed according to a fourth embodiment of the present invention.

FIG. 7 shows a folding collapsible combination storage box assembly constructed according to a fourth embodiment of the present invention. According to this embodiment, the folding collapsible combination storage box assembly comprises two box units vertically connected in a line. The box units are constructed in the same manner as that shown in FIG. 1 with the exception that the box body of the upper box unit has the top side as well as the bottom side opened, i.e., the upper box unit and the a lower box unit have a common open side.

Figure 8:
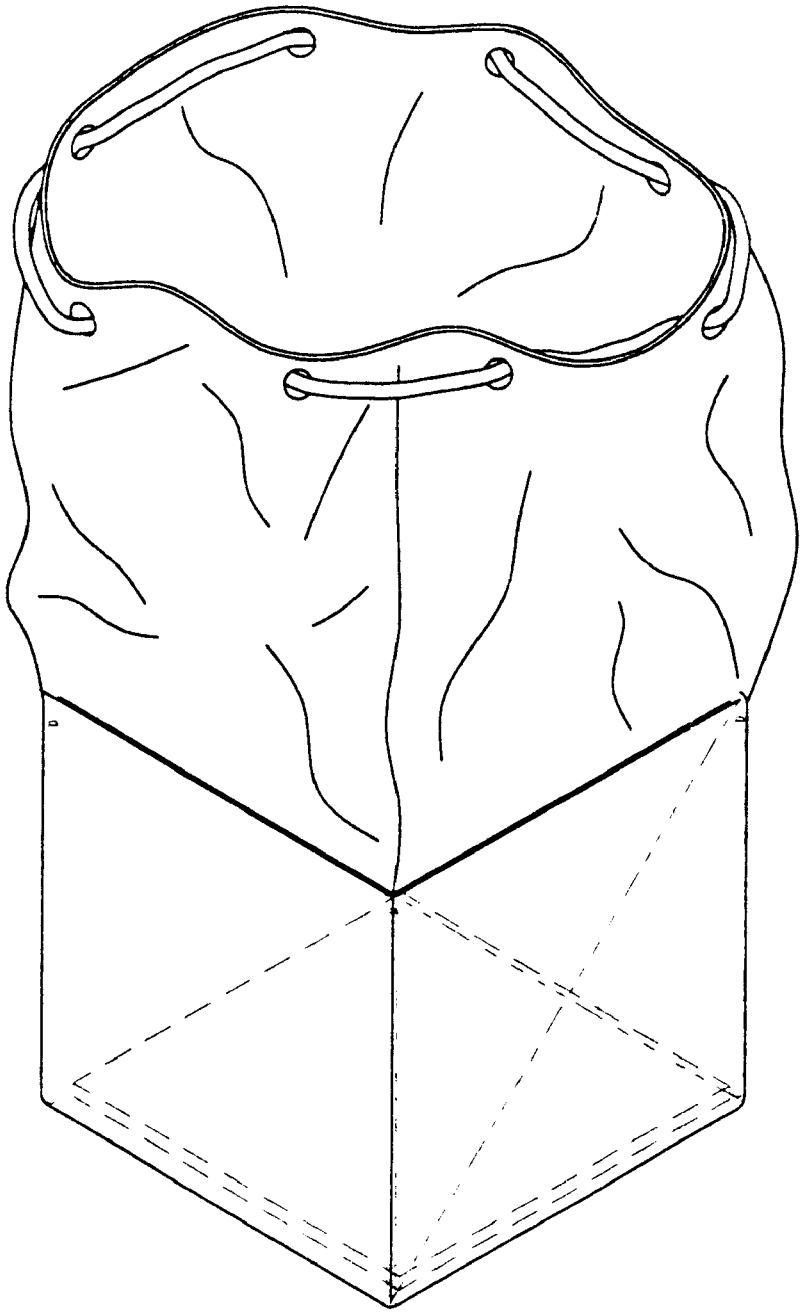
FIG. 8 is a perspective view of the folding collapsible combination storage box assembly constructed according to a fifth embodiment of the present invention.

FIG. 8 shows a folding collapsible combination storage box assembly constructed according to a fifth embodiment of the present invention. According to this embodiment, the folding collapsible combination storage box assembly has its top open side formed integral with a drawstring bag.

Figure 9:
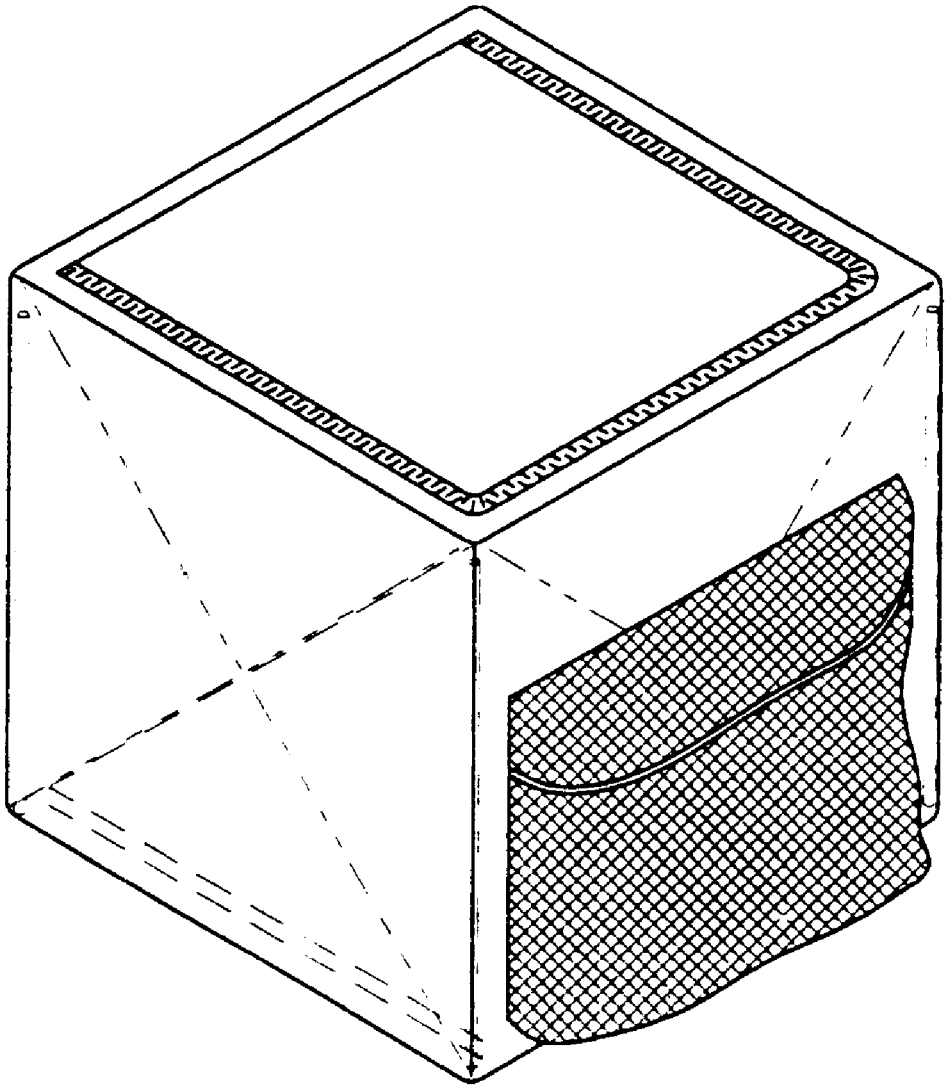
FIG. 9 is a perspective view of the folding collapsible combination storage box assembly constructed according to a sixth embodiment of the present invention.

FIG. 9 shows a folding collapsible combination storage box assembly constructed according to a sixth embodiment of the present invention. According to this embodiment, the folding collapsible combination storage box assembly has an additional a side pocket for keeping small items.

A prototype of folding collapsible combination storage box assembly has been constructed with the features of the annexed drawings of FIGS. 1 through 9. The folding collapsible combination storage box assembly functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A folding collapsible combination storage box assembly comprising two box units each having a collapsible box body, four upright support rods and a hard base plate, said box body being formed of resilient fabric having four vertical peripheral side panels and a horizontal bottom side and defining a top opening, said four upright support rods being embedded in four corners of said collapsible box body, said two box units having a common vertical side panel, said two box units commonly using two upright support rods, said collapsible box body being extended out and supported in a rectangular shape by said upright support rods, said hard base plate being fitted in a respective one of said collapsible bodies for supporting storage items in said collapsible box body, said box body having a rectangular fabric cover panel adapted for closing said top opening, said rectangular fabric cover panel having one peripheral side panel of said box body by stitches and three other sides detachably fastened to a topmost edge of other three vertical peripheral side panels of said box body by a zip fastener, whereby when not in use, said hard base plate of each of said box units is lifted from horizontal to vertical and closely attached to one vertical peripheral side panel of said collapsible box body, and then one of said box units is twisted with another one of said box units into a collapsed flat manner thereby reducing storage space.

2. A folding collapsible combination storage box assembly comprising two box units each having a collapsible box body, four upright support rods and a hard base plate, said box body being formed of resilient fabric having four vertical peripheral side panels and a horizontal bottom side and defining a top opening, said four upright support rods being embedded in four corners of said collapsible box body, said two box units having a common vertical side panel, said two box units commonly using two upright support rods, said collapsible box body being extended out and supported in a rectangular shape by said upright support rods, said hard base plate being fitted in a respective one of said collapsible bodies for supporting storage items in said collapsible box body, each of said box units having a top side formed integral with a drawstring bag, whereby when not in use, said hard base plate of each of said box units is lifted from horizontal to vertical and closely attached to one vertical peripheral side panel of said collapsible box body, and then one of said box units is twisted with another one of said box units into a collapsed flat manner thereby reducing storage space.

* * * * *